United States Patent [19]

Peckitt et al.

[11] Patent Number: 4,855,646

[45] Date of Patent: Aug. 8, 1989

[54] FLUORESCENT ILLUMINATOR WITH INVERTER POWER SUPPLY

[75] Inventors: Guy R. Peckitt, Mar Vista; Edward E. Kopelman, Beverly Hills, both of Calif.

[73] Assignee: Techni-Quip Corp., Hollywood, Calif.

[21] Appl. No.: 54,516

[22] Filed: May 27, 1987

[51] Int. Cl.[4] ..... H05B 41/29

[52] U.S. Cl. ..... 315/175; 315/174; 315/219; 315/200 R; 315/DIG. 4; 350/523; 362/33; 362/362

[58] Field of Search ..... 315/200 R, DIG. 4, 219, 315/307, 314, 315, 174–176; 362/33, 84, 191, 187, 188, 362; 350/523

[56] References Cited

U.S. PATENT DOCUMENTS

| | | | |
|---|---|---|---|
| 4,188,661 | 2/1980 | Bower et al. | 315/224 X |
| 4,207,497 | 6/1980 | Capewell et al. | 315/DIG. 4 |
| 4,286,195 | 8/1981 | Swinea, Jr. | 315/DIG. 4 |
| 4,286,196 | 8/1981 | Auer | 315/307 |
| 4,358,710 | 11/1982 | Magai | 315/DIG. 4 |
| 4,367,434 | 1/1983 | Miller | 315/DIG. 4 |
| 4,373,146 | 2/1983 | Bonzali et al. | 315/174 X |
| 4,392,086 | 7/1983 | Ide et al. | 315/174 |
| 4,395,660 | 7/1983 | Waszkiewicz | 315/DIG. 4 |
| 4,443,740 | 4/1984 | Goralnik | 315/DIG. 4 |
| 4,513,364 | 4/1985 | Nilssen | 315/219 |

*Primary Examiner*—James J. Groody
*Assistant Examiner*—Mark R. Powell
*Attorney, Agent, or Firm*—Joseph S. Iandiorio; Brian M. Dingman

[57] ABSTRACT

A fluorescent illuminator including a fluorescent lamp, a lamp housing, and a lamp power supply with a variable current output with a relatively fixed frequency at least an order of magnitude greater than line frequency and a non-integral multiple thereof. There are means for connecting the power supply to the lamp and also means for varying the current output of the power supply between a first, lowest level and a second, highest level to change the light intensity of the fluorescent lamp.

23 Claims, 4 Drawing Sheets

FLUORESCENT ILLUMINATOR WITH INVERTER POWER SUPPLY

FIELD OF INVENTION

This invention relates to a fluorescent illuminator and more particularly to a fluorescent ring illuminator which has a variable light output controlled by a power supply with a variable current output at a relatively high frequency.

BACKGROUND OF INVENTION

Traditional microscopic inspection ring illuminators have either incandescent, fiber-optic or fluorescent light sources. Each of these traditional light sources exhibit problems which may contribute to decreased sample resolution and/or operator fatigue. The light output of incandescent bulbs decreases with distance from the bulb filament, rather than from the bulb surface as with fluorescent bulbs. As a result, the light incident on an object being inspected may be inconsistent, creating shadows and poor viewing. In addition, ring-shaped incandescent bulbs are extremely difficult to make. On the other hand, fiber-optic ring illuminators generally supply light all around an object being illuminated but have a relatively high cost and a relatively short life.

In contrast, fluorescent ring illuminators supply a relatively steady light output which can be directed almost all around an object being viewed. In addition, those light sources are relatively inexpensive and have a relatively long life. Therefore, fluorescent sources are best suited for microscopic inspection ring illuminators.

Traditional fluorescent ring illuminators used as light sources for microscopic inspection typically lack many features which could contribute to superior illumination and decreased operator eye strain. These illuminators typically operate at 60 Hz. This relatively low frequency causes both flicker and hum, which contribute to user fatigue and may decrease productivity of an operator using an inspection device with this conventional light source. In addition, the 60 Hz frequency interferes with high resolution image processing because most image processing equipment in the United States operates at a vertical scan rate of 60 Hz. Thus, a traditional fluorescent light source used in conjunction with this image processing equipment may cause generation of dark interference bands on a video output screen as a result of the coincidence of light flicker frequency and video scan rate.

As these fluorescent ring illuminators are traditionally used as microscope mounted light sources, it would be desirable to have the capability of dimming and brightening the light source to illuminate different objects for visual inspection. Presently, fluorescent illuminators do not have dimming and brightening capabilities. As a result, highly polished objects may appear very bright, and dull objects may appear too dark. These problems can also lead to increased eye strain and decreased productivity.

As with any electrical instrument, fluorescent illuminators should be properly grounded and shielded. Traditionally, the lamp housings for ring illuminators are non-metallic. Because of this, the housing cannot be grounded and does not protect the bulb from breaking. Also, the power feed cable of these illuminators is typically not shielded. This lack of shielding can cause video image problems if the illuminator is used in conjunction with image processing equipment, and/or the illuminator may interfere with operation of electrical devices in close proximity to it.

SUMMARY OF INVENTION

It is therefore an object of this invention to provide a fluorescent illuminator which has a variable light intensity.

It is a further object of this invention to provide a fluorescent illuminator in which the light intensity can be increased.

It is a further object of this invention to provide a fluorescent illuminator in which the light intensity can be decreased.

It is a further object of this invention to provide a fluorescent illuminator that operates without 60 Hz hum and flicker.

It is a further object of this invention to provide a fluorescent illuminator that does not interfere with image processing equipment.

It is a further object of this invention to provide a fluorescent illuminator which can be properly grounded.

It is a further object of this invention to provide a fluorescent illuminator which is sturdy and protects the bulb from breaking.

This invention results from the realization that truly effective fluorescent illuminator control can be accomplished by varying the current fed to the fluorescent lamp while keeping the voltage and frequency relatively constant and from the further realization that 60 Hz flicker, hum and video interference can be eliminated by operating at an order of magnitude or more greater than and at a non-integral multiple of 60 Hz.

This invention features a fluorescent illuminator which has a fluorescent lamp, a lamp housing, and a lamp power supply with a variable current output with a relatively fixed frequency at least an order of magnitude greater than line frequency and a non-integral multiple thereof. In addition, the fluorescent illuminator includes means for connecting the power supply to the lamp and means for varying the current output between a first, lowest level and a second, highest level to change the light intensity of the lamp.

Preferably, the means for varying the current output of the lamp power supply includes means for varying the current substantially linearly between a third, intermediate level and the first, lowest level. This embodiment may also include means for switching the current between the second, highest level and a lower level. This means for switching preferably includes momentary switch means for momentarily increasing the current from a current level lower than the second, highest level to this second, highest level.

The frequency of the lamp power supply output is preferably approximately 20 KHz. The fluorescent illuminator may further include means for maintaining the voltage of the power supply output relatively constant while the current of this output is varying. This voltage may be approximately 90 VAC.

The means for connecting the power supply to the lamp preferably includes a cable with modular plugs on each end for removably engaging the power supply and the lamp. The cable may include shielding to reduce electromagnetic transmission and interference. The means for connecting the power supply to the lamp may also include contacts mounted on the lamp housing for making electrical contact with the lamp. In this embodiment, the means for connecting also includes contacts mounted on the lamp for making electrical contact with the lamp.

The fluorescent lamp of a preferred embodiment of the fluorescent illuminator may be essentially ring-shaped. The housing may be made of aluminum to protect the lamp, provide a reflective surface, and provide electrical continuity for grounding. The housing may also include a mounting ring for mounting the housing on a microscope. The fluorescent illuminator also preferably includes means for earth grounding the housing and the power supply.

In an alternative preferred embodiment, a fluorescent illuminator according to the present invention may include a fluorescent lamp, a lamp housing, an inverter with a variable current output with a relatively fixed frequency and means for connecting the inverter to the lamp. In addition, there is a regulated DC power supply with a variable voltage output connected to the inverter, and means for varying the current output of the inverter to change the light intensity of the lamp.

The means for varying the current output of the inverter preferably includes control means for varying the voltage output of the power supply. The fluorescent illuminator may also include means for maintaining the voltage of the inverter current output relatively constant while the current output is varying. In this embodiment, the voltage of the current output is approximately 90 VAC. The frequency of the inverter output may be at least an order of magnitude greater than line frequency and a non-integral multiple thereof. Preferably, this frequency is approximately 20 KHz.

DISCLOSURE OF PREFERRED EMBODIMENT

Other objects, features and advantages will occur from the following description of a preferred embodiment and the accompanying drawings, in which.

Figure 1:
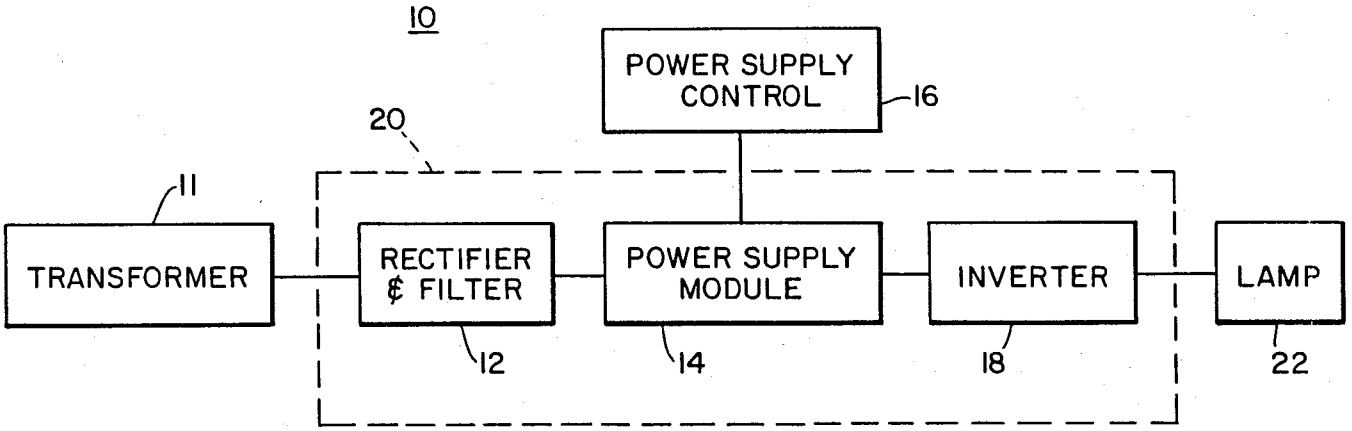
FIG. 1 is a schematic diagram of a fluorescent illuminator according to the present invention.

A fluorescent illuminator according to this invention may be accomplished using a lamp power supply with a variable current output at a relatively high frequency at least an order of magnitude greater than line frequency and a non-integral multiple thereof. This frequency is preferably approximately 20 KHz. The fluorescent illuminator also includes a fluorescent lamp, a lamp housing, means for connecting the power supply to the lamp, and means for varying the current output of the lamp power supply between a first, lowest level and a second, highest level to change the light intensity of the lamp.

The means for varying the current output of the lamp power supply may include means for varying the current substantially linearly between a third, intermediate level and the lowest level. In addition, the means for varying the current output may include means for switching the current between the highest level and any other level. This means for switching is preferably a momentary switch for momentarily increasing the current from any level lower than the highest level to the highest level. The voltage of this current ouput may be held relatively steady, typically at approximately 90 VAC, while the current output is varying.

The lamp housing is preferably made of aluminum and includes a mounting ring for mounting the housing on a microscope. In addition, the lamp may be essentially ring shaped and the lamp housing similarly shaped.

The means for connecting the power supply to the lamp may include a cable with modular plugs on each end for removably engaging the power supply and the lamp. This cable may also include shielding to reduce electromagnetic transmission and interference. The means for connecting the power supply to the lamp may also include contacts mounted on the housing for making electrical contact with the lamp. In this embodiment, the lamp preferably includes contacts mounted on its ends for making electrical contact with the contacts mounted on the housing. The fluorescent illuminator of the present invention may also include means for earth grounding the housing and the power supply.

In an alternative preferred embodiment, the fluorescent illuminator of the present invention may include a regulated DC power supply with a variable voltage output connected to an inverter with a variable current output with a relatively fixed frequency. This fluorescent illuminator also includes a fluorescent lamp, a lamp housing, a means for connecting the inverter to the lamp, and a means for varying the current output of the inverter to change the light intensity of the lamp.

The current output of the inverter may be varied by a control means for varying the voltage output of the DC power supply feeding the inverter. The voltage of the inverter output may be held relatively constant, typically at approximately 90 VAC, while the inverter current output is varying.

Preferably, the inverter current output has a relatively fixed frequency which may be at least an order of magnitude greater than line frequency and a non-integral multiple thereof and may be approximately 20 KHz.

There is shown in FIG. 1 a schematic diagram of a fluorescent illuminator 10 including a lamp power supply 20 shown in dashed line. This lamp power supply 20 preferably includes rectifier and filter 12 which receives power from transformer 11. Transformer 11 is a step-down transformer for converting line voltage to a lower voltage, typically 24 VAC. Rectifier and filter 12 converts this AC signal to DC and supplies power supply module 14. Power supply module 14 is typically a regulated DC power supply with an output varied from approximately 6 to 18 volts DC. Power supply module 14 is controlled by power supply control 16.

The signal fed to inverter 18 is thus a DC signal varying between approximately 6 and 18 VDC. Inverter 18 typically includes a self-starting oscillator for changing the DC voltage to a high frequency AC voltage. This frequency is typically at least an order of magnitude greater than and a non-integral multiple of line frequency, 60 Hz, and is preferably approximately 20 KHz. This high frequency AC voltage is then stepped up by a step-up transformer also included in inverter 18. The transformer output is typically between 90 and 130 VAC. Inverter 18 thus acts to vary the current level of its output in direct response to the varying DC voltage of its input.

As a result, power fed to lamp 22 has a relatively constant voltage, a relatively constant and high frequency, and a variable current, typically from 150–450 ma. Fluorescent lamp 22 is driven with variable current to alter its light intensity. Since fluorescent lamps typically will not operate below approximately 90 VAC, the output of inverter 18 must be held at or above this level.

Figure 2:
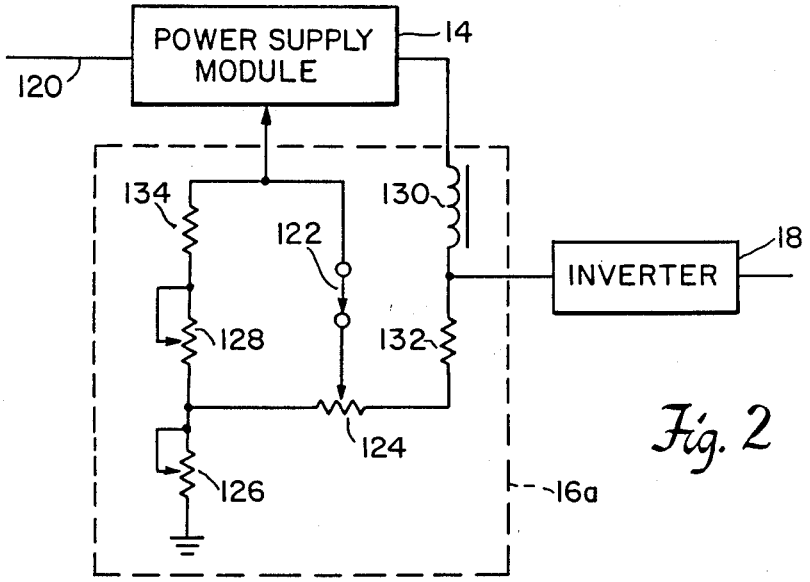
FIG. 2 is a schematic diagram of the power supply control of FIG. 1.

FIG. 2 shows power supply control 16*a*, in dashed line, in more detail. Power supply module 14 is fed by rectifier and filter 12, FIG. 1, over line 120. Module 14 may be a Lambda #LAS 6330P Monolithic Switching Regulator. This is a fixed-frequency regulated DC power supply. Power supply control 16*a* consists of intensity control potentiometer 124, normal voltage adjust variable resistor 126, boost limit variable resistor 128, momentary, normally closed switch 122, bias resistors 132 and 134, and inductor 130.

In operation, resistor 126 is set to hold the power supply module output to a median level, typically 12 VDC, when potentiometer 124 is at its initial, "on" position. The voltage output of module 14 is decreased by adjusting potentiometer 124 to decrease the control voltage returned to the error amplifier, not shown, in module 14. The voltage output of module 14 can thus be decreased substantially linearly to a low level of approximately 6 VDC to decrease the current output of inverter 18, FIG. 1, from an initial level of approximately 300 ma to a low level of approximately 150 ma. Inverter 18 may be a Bodine #12F30-40E.

To increase the current output of inverter 18 to a high level of approximately 450 ma, switch 122 is opened, thereby disconnecting potentiometer 124. The voltage returned to the error amplifier is now controlled by boost limit 128, which is set to drive module 14 to output a high level of approximately 18 VDC, which in turn drives the output of inverter 18 to a high level of approximately 450 ma. Since switch 122 is momentary, when it is released intensity control 124 is placed back in operation, and the power supply module immediately returns to the level it was at before switch 122 was pushed. Thus, lamp 22, FIG. 1, can be momentarily brightened by pushing switch 122, and returns to its pre-brightened level as soon as switch 122 is released.

Figure 3A:
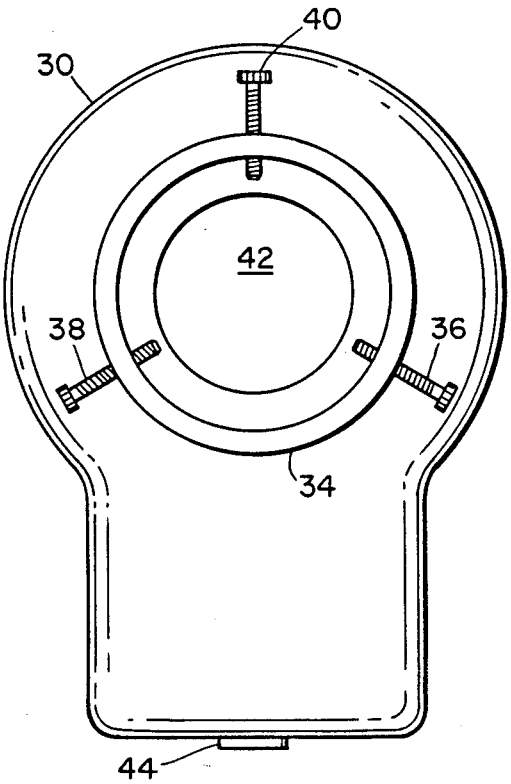
FIG. 3A is a top plan view of a lamp housing of a fluorescent illuminator according to this invention.

FIG. 3A shows a lamp housing 30 for mounting and protecting a fluorescent lamp. Lamp housing 30 includes housing body 32 which is essentially keyhole shaped. Body 32 includes central hole 42 which allows housing 30 to be slipped over and fastened to a microscope lens. Housing 30 also includes mounting ring 34 and mounting screws 36, 38 and 40. Mounting ring 34 and the associated mounting ring screws are positioned to allow screw engagement with the microscope lens. These screws hold lamp housing 30 just above the microscope lens. Lamp housing body 32 also includes modular receptacle 44 for engaging a modular plug on the power supply cable, not shown.

Figure 3B:
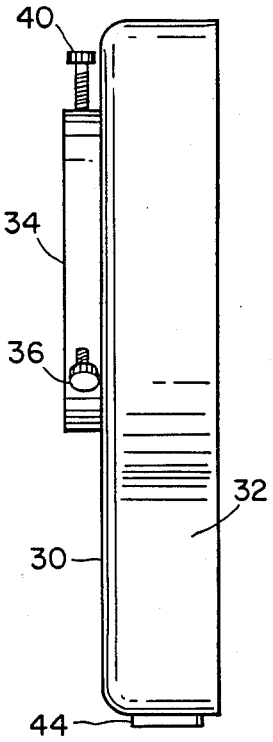
FIG. 3B is a side elevational view of the lamp housing of FIG. 3A.

FIG. 3B shows a side view of the lamp housing 30 of FIG. 2A. Housing body 32 includes mounting ring 34 and mounting ring screws 36, 40, and 38, not shown. The mounting screws have knurled heads to facilitate hand tightening and loosening. Lamp housing body 32 also includes modular plug 44, which is typically a female modular receptacle.

Figure 3C:
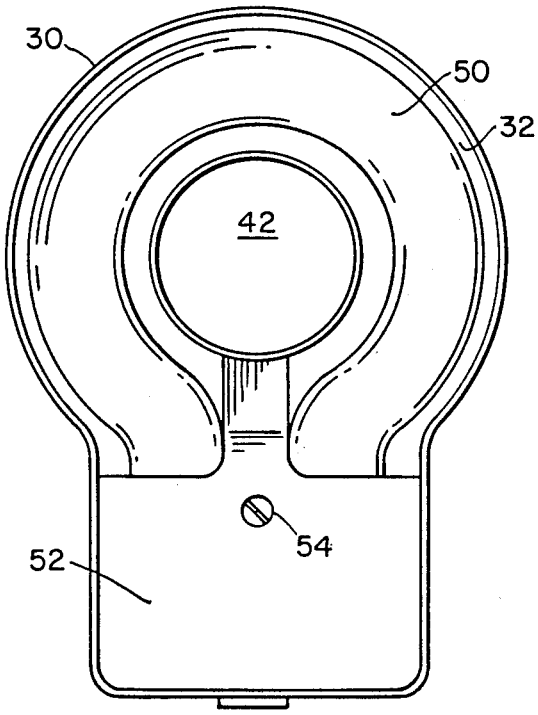
FIG. 3C is a bottom plan view of the lamp housing of FIG. 3A showing the lamp and lamp cover.

The lamp housing 30 is shown from the bottom in FIG. 3C. Lamp housing body 32 is preferably a relatively thin shell machined from aluminum. This shell is shaped to closely fit the shape of a lamp such as lamp 50. Lamp housing 30 also includes lamp cover 52, held in place by screw 54. Lamp cover 52 serves to isolate the electrical contacts located below it and also helps hold lamp 50 in place. Lamp cover 52 also serves to partially block the light output from the straight legs of lamp 50. Lamp housing body 32 also includes central hole 42 for allowing housing 30 to be slipped over the lens of a microscope, not shown.

By making lamp housing body 32 from aluminum, and shaping the working portion in an annular shape, the fluorescent illuminator is able to provide a relatively steady light essentially all around an object bein viewed through the microscope lens, not shown. In addition, this aluminum housing body 32 and lamp cover 52 provide physical protection to lamp 50 and a means for earth-grounding lamp 50 and lamp housing 30.

Figure 3D:
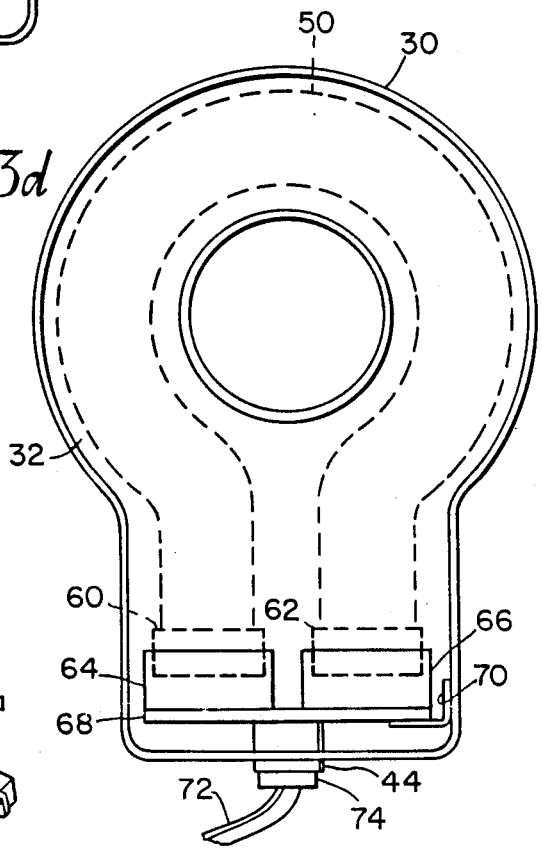
FIG. 3D is a partially disassembled bottom plan view of the lamp housing of FIG. 3A.

This means for earth grounding lamp housing 30 and lamp 50 is shown in detail in FIG. 3D. Lamp 50, shown in dashed line, includes electrical contacts such as contacts 60 and 62, also in dashed line. These contacts 60 and 62 are sized to closely fit similar contacts 64 and 66 mounted on circuit board 68. Modular receptable 44 is also mounted on circuit board 68. Modular plug 74 on power supply cord 72 is adapted to removably engage modular receptacle 44.

Lamp 50 and lamp housing 32 are earth grounded through bracket 70 which is soldered to circuit board 68 and the inside of housing 32. This provides electrical continuity between lamp 50, housing 32, and power supply cord 72 which includes a grounding wire, not shown.

Figure 4:
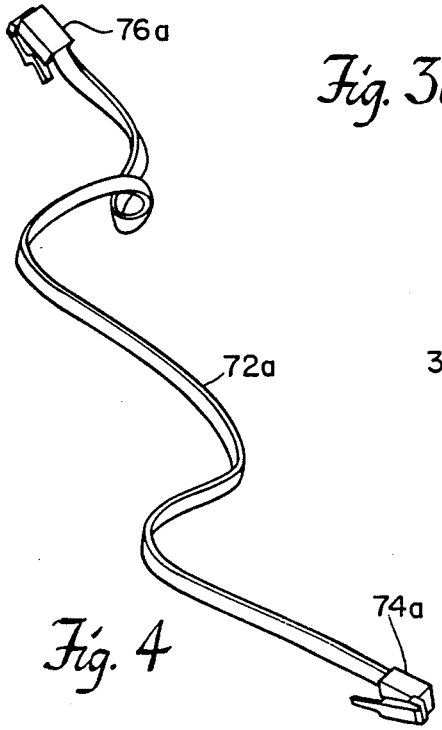
FIG. 4 is a side elevational view of a power supply cable with modular plugs according to the present invention.

Power supply cord 72*a* is shown in detail in FIG. 4. Supply cord 72*a* includes power supply lines and a grounding line, not shown, and may also be shielded. Cable 72*a* has modular plug 76*a* and 74*a* at either end designed to removably engage modular receptacles on the lamp housing and power supply, not shown.

Figure 5A:
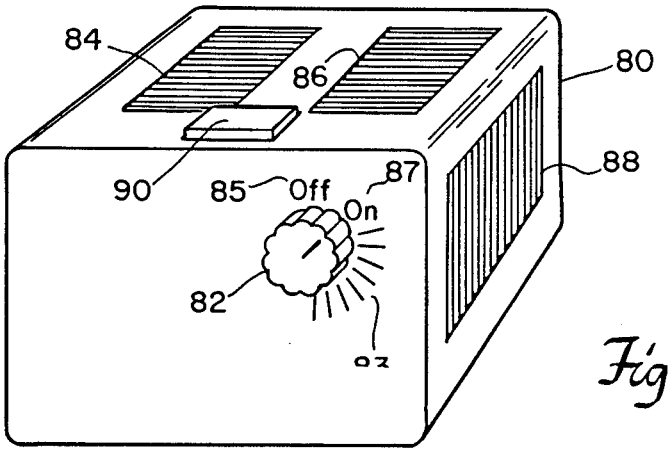
FIG. 5A is a front axonometric view of a lamp power supply for a fluorescent illuminator according to this invention.

The power supply for the fluorescent illuminator is shown in FIG. 5A. Power supply 80 includes on/off-/dimmer knob 82 on its front face. Knob 82 is shown in the "on" position 87, which is located next to "off" position 85 in a clockwise direction. Knob 82 may be moved further in a clockwise direction along light intensity indication lines 83. Lines 83 give a relative indication of intensity of the fluorescent lamp fed by power supply 80.

Lamp power supply 80 also includes switch 90 and heat dissipation vents 84, 86 and 88. In operation, knob 82 is moved from its "off" position 85 in a clockwise manner to "on" position 87. At this position, the current supplied to the lamp is at an intermediate level, typically approximately 300 ma. The lamp may be dimmed by continuing the clockwise rotation of knob 82. This rotation causes the lamp power feed to decrease linearly to a lower level of approximately 150 ma. Since lamp intensity has an approximately linear relationship with lamp power supply current, the lower limit of the light intensity is approximately 50 percent of the intermediate, normal light intensity output which occurs when knob 82 is turned to "on" position 87.

Switch 90 is a momentary switch which, when depressed, cuts off the lamp dimming circuitry and replaces it with a lamp brightening circuit. This lamp brightening circuit causes the power fed to the lamp to increase to a high level of approximately 450 ma. This current level overdrives the lamp and produces a light intensity which is approximately 25 percent greater than the intermediate light intensity put out at 300 ma.

Figure 5B:
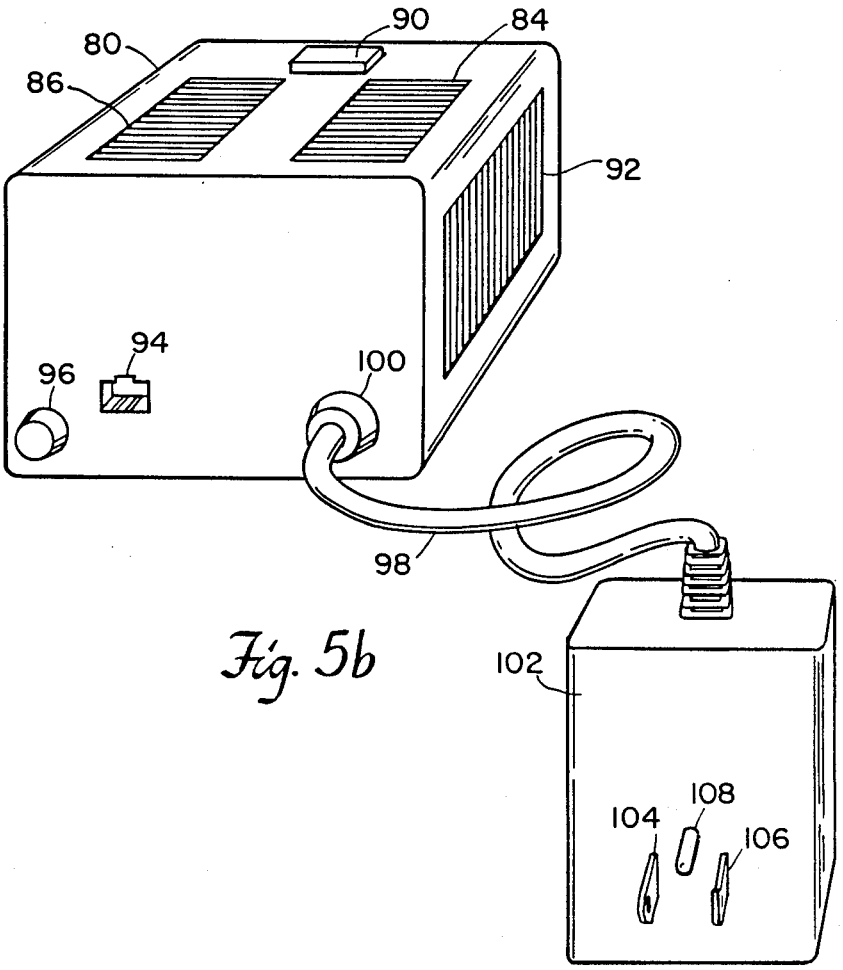
FIG. 5B is a rear axonometric view of the power supply of FIG. 5A.

The back of the lamp power supply is shown in FIG. 5B. Power supply 80 includes momentary switch 90 and heat dissipation vents 86, 84 and 92. The back face of power supply 80 includes modular receptacle 94 for receiving the modular plug of the lamp power supply cord, not shown. Power supply 80 also includes fuse 96 which protects the electronic circuitry from power surges.

Power to power supply 80 is fed through line cord 98 permanently attached with grommet 100 and originating from transformer 102. Transformer 102 has plugs 104, 106 and 108 for engaging a standard 115 VAC/60 Hz line outlet.

Although specific features of the invention are shown in some drawings and not others, this is for convenience only as each feature may be combined with any or all of the other features in accordance with the invention.

Other embodiments will occur to those skilled in the art and are within the following claims:

What is claimed is:

1. A fluorescent illuminator comprising:

a fluorescent lamp;

a lamp housing;

a lamp power supply unit having an AC voltage output with a relatively constant amplitude and a relatively fixed frequency of at least an order of magnitude greater than line frequency and a non-integral multiple thereof for supplying an output current to said lamp;

means for connecting said power supply to said lamp; and means for adjusting said output current between a first, lowest level and a second, intermediate level to change the light intensity of said lamp.

2. The fluorescent illuminator of claim 1 further including means for earth-grounding said power supply.

3. The fluorescent illuminator of claim 1 in which said means for enabling adjustment includes means for switching said current between a third, highest level and a lower level.

4. The fluorescent illuminator of claim 3 in which said means for switching includes momentary switch means for momentarily increasing said current from a current level lower than said third, highest level to said second, highest level.

5. The fluorescent illuminator of claim 1 in which said frequency is approximately 20 KHz.

6. The fluorescent illuminator of claim 1 further including means for maintaining the voltage of said AC output relatively constant while said current is adjusted.

7. The fluorescent illuminator of claim 6 in which said voltage is approximately 90 VAC.

8. The fluorescent illuminator of claim 1 in which said means for connecting includes contacts mounted on said housing for making electrical contact with said lamp.

9. The fluorescent illuminator of claim 8 in which said means for connecting includes contacts mounted on said lamp for making electrical contact with said lamp.

10. The fluorescent illuminator of claim 1 in which said housing includes a mounting ring for mounting said housing on a microscope.

11. The fluorescent illuminator of claim 1 in which said housing is made of aluminum.

12. The fluorescent illuminator of claim 1 in which said lamp is essentially ring shaped.

13. The fluorescent illuminator of claim 1 in which said means for connecting includes a cable with modular plugs on each end for removably engaging said power supply and said lamp.

14. The fluorescent illuminator of claim 1 in which said means for connecting includes a cable with shielding to reduce electromagnetic transmission and interference.

15. The fluorescent illuminator of claim 1 further including means for earth-grounding said housing.

16. A fluorescent illuminator comprising:

a fluorescent lamp;

a lamp housing;

an inverter with an AC voltage output of substantially constant amplitude and frequency and an adjustable current;

means for connecting said inverter to said lamp;

a regulated DC power supply with a substantially linearly adjustable DC voltage output connected to said inverter; and means for adjusting said DC voltage output to vary said current to change the light intensity of said lamp.

17. The fluorescent illuminator of claim 16 in which said means for enabling adjustment includes control means for varying said voltage output of said power supply.

18. The fluorescent illuminator of claim 16 in which said frequency is at least an order of magnitude greater than line frequency and a non-integral multiple thereof.

19. The fluorescent illuminator of claim 18 in which said frequency is approximately 20 KHz.

20. The fluorescent illuminator of claim 16 further including means for maintaining the voltage of said AC output relatively constant while said current is adjusted.

21. The fluorescent illuminator of claim 20 in which the voltage of said AC output is approximately 90 VAC.

22. A fluorescent lamp controller circuit comprising:

an inverter having an AC voltage output of substantially constant amplitude and frequency and an adjustable output current for lighting a fluorescent lamp;

a regulated DC power supply for supplying an output DC voltage to said inverter; and control means for adjusting the DC voltage of said power supply to adjust the output current of said inverter to alter the light intensity of the lamp.

23. The system of claim 22 in which said control means includes means for linearly adjusting the DC voltage of said power supply.

* * * * *